United States Patent [19]

Hayes

[11] Patent Number: 4,624,304

[45] Date of Patent: Nov. 25, 1986

[54] EXPANDABLE SUPPORT FOR INSERTION INTO TUBE BUNDLE

[75] Inventor: James K. Hayes, Chattanooga, Tenn.

[73] Assignee: Combustion Engineering, Inc., Windsor, Conn.

[21] Appl. No.: 801,444

[22] Filed: Nov. 25, 1985

[51] Int. Cl.[4] ..... F28F 9/00

[52] U.S. Cl. ..... 165/162; 122/510

[58] Field of Search ..... 165/162; 122/510

[56] References Cited

U.S. PATENT DOCUMENTS 3,503,440 3/1970 Romanos ..... 165/162
3,575,236 4/1971 Romanos ..... 165/162
3,864,811 2/1975 Walker ..... 165/162 X
4,429,739 2/1984 Gentry et al. ..... 165/162 X

*Primary Examiner*—William R. Cline
*Assistant Examiner*—Richard R. Cole
*Attorney, Agent, or Firm*—Robert L. Olson

[57] ABSTRACT

In a shell and tube type heat exchanger, flattened tubes (50) are inserted between each layer of tubes (36) in the tube bend region thereof. The flattened tubes are then pressurized, to expand them in the region below the tube bends (60), so that they lock the batwing support plates (41) into place, thus preventing them from vibrating and causing damage to the tubes in the first few rows of the tube bundle.

1 Claim, 8 Drawing Figures

EXPANDABLE SUPPORT FOR INSERTION INTO TUBE BUNDLE

BACKGROUND OF THE INVENTION

Shell and tube type heat exchangers are a common type in use today, particularly in nuclear power plants. One type used passes a heating fluid, such as high temperature water or vapor, through the tubes, which gives up heat to water which flows outside of the tubes, thus generating steam.

Vapor generators of this type commonly employ tube bundles formed of layers of U-shaped tubes, the ends of whose legs are secured to a tubesheet disposed at one end of the shell while the tube bends are located at the opposite end of the shell. Because these tubes have legs of considerable length, especially in high capacity generators, they are susceptible to flow and/or mechanically induced vibrations, and tube spacer and support members are used in the bend area of the tubes. These spacer and support members must be thin enough so that they do not substantially restrict flow of the heated fluid, while still being rigid enough to perform their intended function. In some units which have been in operation for long periods of time, problems have developed, in that the ends of the support plates which extend beyond the boundaries of the tube bundle have vibrated to such an extent that their continued contact with or banging against the tubes in the first two or three rows of the tube bundle have caused wear or damage to these tubes. Thus the problem presently faced is how to prevent the support plates from causing further damage to the tubes, while continuing to adequately space and support these tubes.

SUMMARY OF THE INVENTION

In accordance with the invention, flattened tubes are inserted between each layer of tubes in the tube bend region of a shell and tube type heat exchanger. The flattened tubes are then pressurized, to expand them in the region below the tube bends, so that they lock the batwing support plates into place, thus preventing them from vibrating and causing damage to the tubes in the first few rows of the tube bundle.

DESCRIPTION OF THE PREFERRED EMBODIMENT

Figure 1:
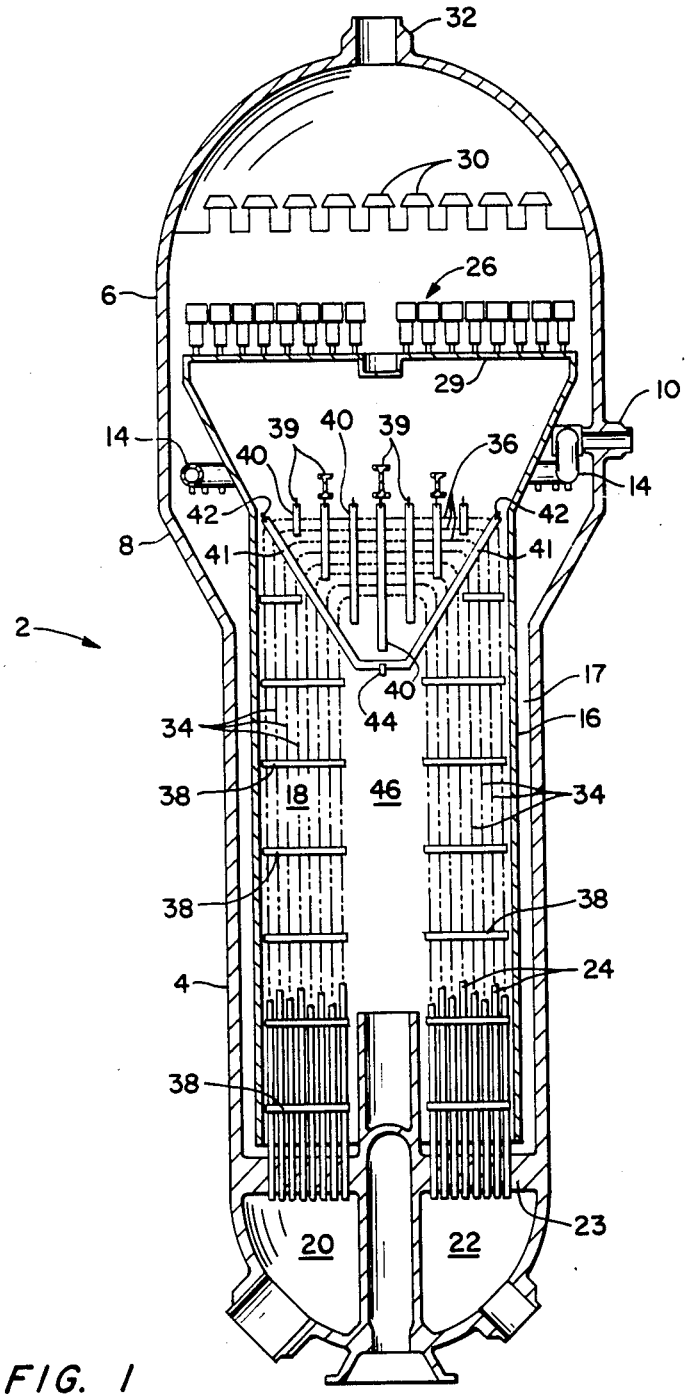
FIG. 1 PRIOR ART
FIG. 1 is a vertical section of a shell and tube type vapor generator where the invention can be employed.

Looking now to FIG. 1, there is shown a shell and tube type heat exchanger 2, having a vertically elongated pressure vessel defined by a lower cylindrical shell section 4 and a larger diameter, upper cylindrical shell section 6, the latter being integrally connected with the former by means of a frustoconical transition member 8. Feedwater enters the vessel through inlet 10 and flows into the annular ring distribution header 14. This water is discharged through a plurality of openings in the header 14, which openings are evenly distributed around the entire circumference of the header. The water flows downwardly between an inner shroud 16 and the walls of the vessel, through the annular downcomer 17. The water upon reaching the bottom of the vessel flows beneath the lower edge of the shroud 16 into the central riser portion 18 of the vessel, where it is heated by the primary heating fluid flowing within the tubes 24.

The heating medium enters tubes 24 from inlet manifold 20, and exits by way of outlet manifold 22. The water after being heated to the point where some steam has been generated, flows through the openings in upper deck 29 and then through the steam-water separators 26, where a majority of the water is separated and flows over the outer edge of the deck 29 into the downcomer 17 to be recycled. The steam continues its upward flow through a plate dryer section 30 where most of the moisture remaining in the now relatively dry steam is removed.

The dried steam exits through outlet 32 to its point of use, for example in driving a turbine. In vapor generators of the above type, the U-tubes 24 of the tube bundle each include a pair of vertical legs 34 interconnected by a horizontal portion 36. All of the tubes are small diameter, thin-walled tubes that are arranged in closely spaced layers, with each layer containing a plurality of internested tubes. In order to provide maximum heat transfer effectiveness, the tube layers of the present arrangement are disposed such that the tubes therein have their centers located on a triangular pitch.

Because the tubes 24 are small diameter, thin-walled members and because the distance between the tubesheet 23 and the top of the tube bundle is extensive, means are provided for spacedly supporting the tubes along their entire length in order to protect them against damage caused by vibration. Such structure is also required in order to impart sufficient rigidity to the tubes to permit them to maintain their mutually spaced relationship in the tube bundle. To support the tube legs, there are egg crate grids 38 located at various elevations. These grids are made up of two sets of parallel bars, one set running in a direction transverse to the other, with the tubes extending up through each opening formed in the grid. The upper horizontal portion of the tubes are supported by bars or plates 40 extending down from and supported from the top by cross beams 39. Horizontal bars (not shown) tie these bars 40 together, to give them some rigidity. There is a set of bars 40 extending down between each layer of tubes in the tube bundle. To support the tube bends, batwing supports or bars 41 extend down from upper support points 42. These batwing supports rest upon a lower bar or plate 44, which gives it some support. Again, there is a batwing support 41 between each layer of tubes in the tube bundle. The steam generator contains a stayed tubesheet. The stay tube minimizes the deflections and stresses in the tubesheet. In the region of the stay tube it is not feasible to have steam generator tubes supported in the tubesheet. Therefore above the stay tube is a recess region containing no tubes. The recess permits at least limited access for inserting various probes for inspection and maintenance purposes. This central recess is approximately three feet in diameter.

The above construction typifies many of the steam generators that are in operation today. Some of these units have been operating for many years. During regularly scheduled shutdowns, it has been discovered that problems have developed in that some of the tubes in the area of the batwings 41 are showing some fretting and wear, in the two or three rows of tubes closest to the central cavity or recess 46. It has been determined that this wear is occurring because of the flow induced vibration of the batwing supports 41 in the area of the recess 46. This vibration causes the supports 41 to rub and bang up against the adjacent tubes, thus producing the aforementioned fretting and erosion of the tubes. These batwing supports 41 are only approximately one-tenth of an inch thick, and thus are readily susceptible to vibration.

Figure 2:
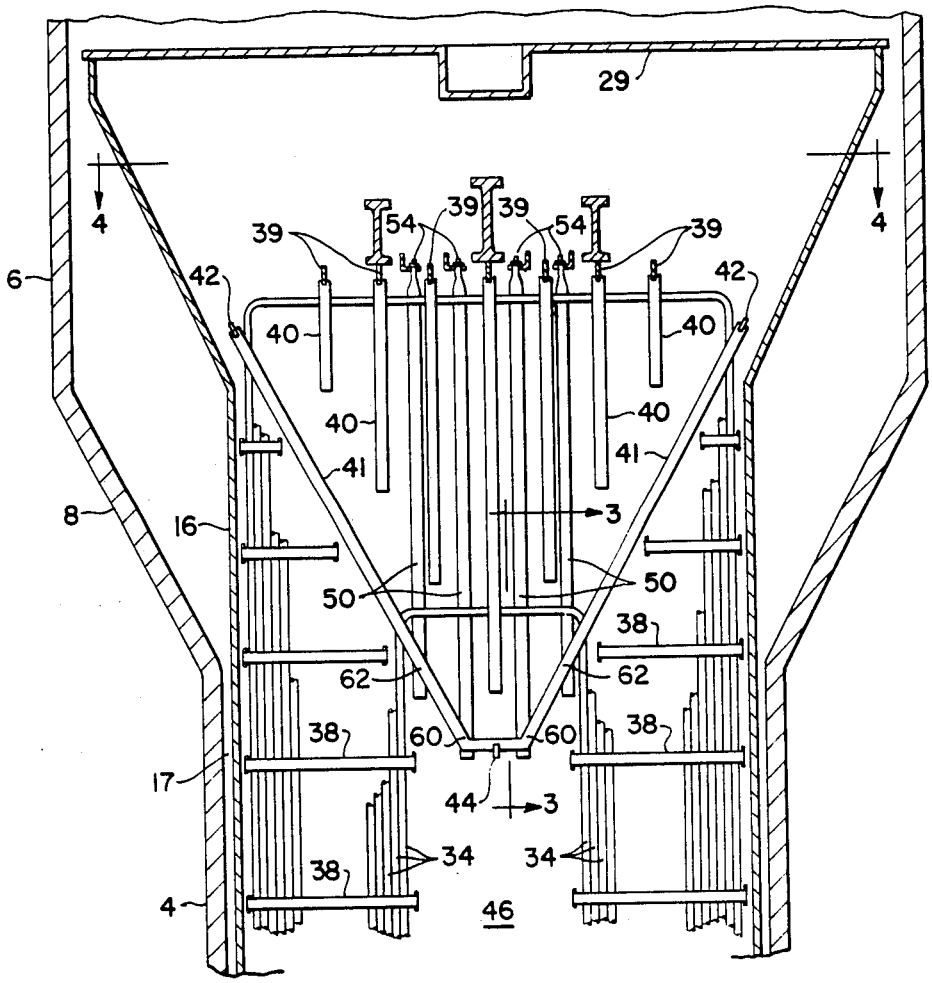
FIG. 2 is an enlarged partial view of the tube U-bend region with the invention in place.
Figure 3:
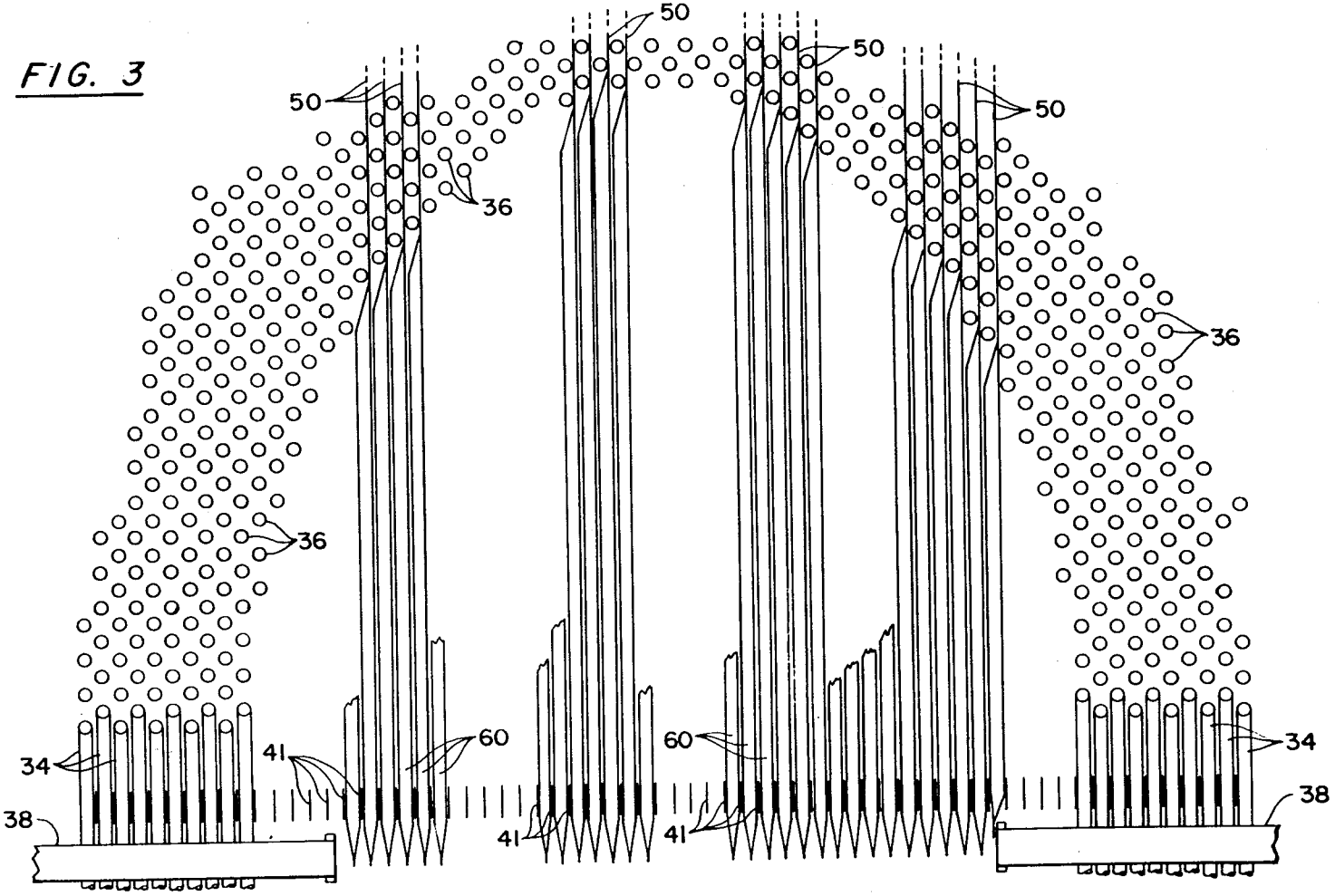
FIG. 3 is a view taken on line 3—3 of FIG. 2.
Figure 6:
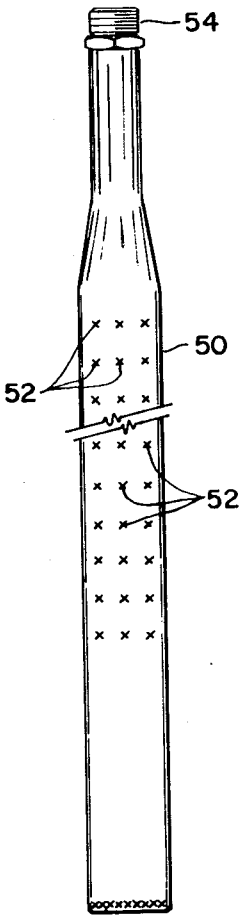
FIG. 6 is a side view of one of the expandable tube supports of the invention.
Figure 4:
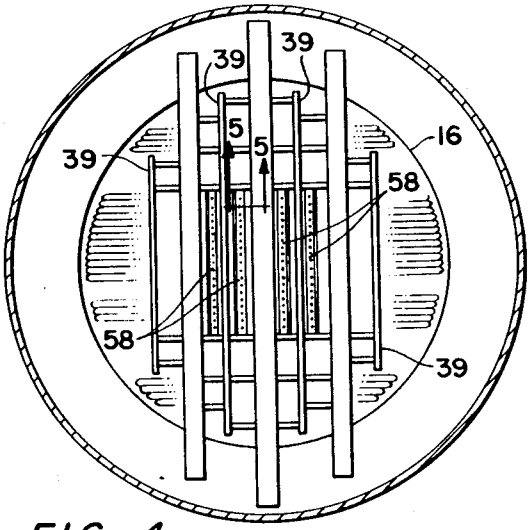
FIG. 4 is a view taken on line 4—4 of FIG. 2.
Figure 5:
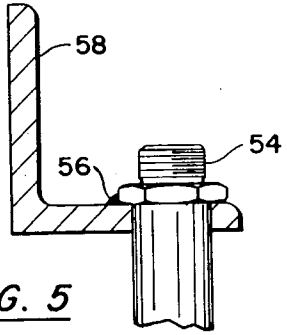
FIG. 5 is a view taken on line 5—5 of FIG. 4.

FIGS. 2–8 show the manner in which the above wear problem is solved in accordance with the invention. During a shutdown of the unit, tubular members 50 (FIGS. 6 and 7) which have portions that have been flattened, are inserted down through the upper portion of the tube bundle at four locations (FIG. 2). One member is inserted between each row of tubes, as best seen in FIG. 3. As seen in FIG. 6, each flattened section has a plurality of spot welds 52, the purpose of which will be further explained later. Each tubular member has a swagelock male connector 54 to which a source of pressurized fluid can be connected. As shown in FIGS. 4 and 5, the upper ends of these tubular members are supported by being welded at 56 to support members 58.

Figure 8:
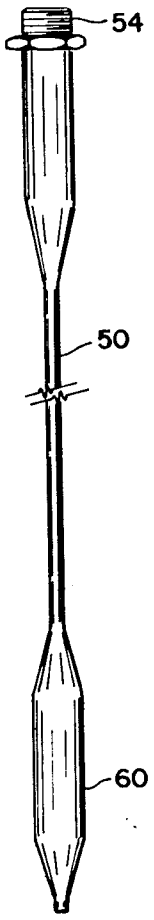
FIG. 8 is a view similar to FIG. 7, showing the flattened tube after it has been pressurized or expanded.
Figure 7:
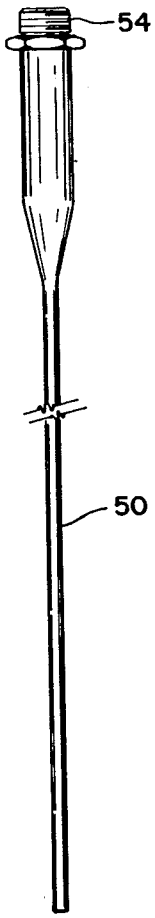
FIG. 7 is a view taken on line 7—7 of FIG. 6.

After the flattened tubular members have been secured in place, a source of fluid (not shown) is connected to each connector, to apply fluid at a given pressure to each of the tubular members. This causes the flattened portion of each tubular member to expand in the regions where spot welds have not been applied. FIGS. 3 and 8 show the expanded portions. The spot welds weld the two sides of the tubular members together so as to prevent this area of the member from being expanded, but does not prevent pressurized fluid from flowing therepast. As seen in FIGS. 2 and 3, the expanded portions of the tubular members tend to securely position and hold the batwings in place at both locations 60 and 62. Thus after the pressurizing fluid equipment and other apparatus have been removed, and the unit is again put into operation, the batwings are effectively locked in place by the expanded members, and no longer will cause fretting and wear of the tubes of the generator. Although the expandable members have been shown as being positioned at the pairs of locations 60 and 62, it is possible that the members located at either one or the other of the pairs of locations will be sufficient to prevent movement of the batwings. Thus, the expandable members could possibly be eliminated from one or the other of the pairs of locations and still provide the support necessary to prevent wear of the tubes within the bundle.

What is claimed is:

1. In a shell and tube heat exchanger, including an upright vessel housing a plurality of rows of internested U-tubes, which U-tubes have both ends secured to the tube sheet near the bottom of the vessel, with the U-bends being located near the top thereof, said internested U-tubes extending from a point adjacent the vessel wall, to a point adjacent the central axis thereof, there being a cylindrical open space along the longitudinal axis of the vessel inside of the U-tubes, a plurality of support bars supporting the U-bends of the tubes, there being a bar between each row of U-tubes, which extends from a position outside of the U-tubes to a position in the cylindrical open space, the method of supporting and spacing the support bars and the U-bends, including the steps of positioning a flattened metal tubular member between each row of internested U-tubes, extending from a position outside of the U-tubes to a position in the cylindrical open space, wherein each flattened tube has been spot welded at various points in the portion of the flattened tube that will lie between the internested U-tubes to prevent expansion of that portion of the tube, applying a pressure to each of the flattened tubes to cause that portion of each flattened tube to expand which lies in the cylindrical open space, thus supporting each end of each of the bars, holding such bars firmly in place.

* * * * *